United States Patent [19]

Hankvist et al.

[11] Patent Number: 4,881,688

[45] Date of Patent: Nov. 21, 1989

[54] DEVICE FOR INSULATING THE SPRAY LIQUID SOURCE FROM THE HIGH TENSION VOLTAGE OF AN ELECTROSTATIC SPRAY SYSTEM WHEN USING AN ELECTRICALLY CONDUCTIVE SPRAY LIQUID

[75] Inventors: Bo A. Hankvist, Stockholm; Peter N. Kling, Nacka; Rolf T. Spongh, Tyresö, all of Sweden

[73] Assignee: Atlas Copco Aktiebolag, Nacka, Sweden

[21] Appl. No.: 265,226

[22] Filed: Oct. 31, 1988

[30] Foreign Application Priority Data

Nov. 4, 1987 [SE] Sweden ..... 87043097

[51] Int. Cl.[4] ..... B05B 5/02

[52] U.S. Cl. ..... 239/691; 118/629; 118/636; 427/27

[58] Field of Search ..... 239/690, 691, 3; 118/629, 636; 427/27

[56] References Cited

U.S. PATENT DOCUMENTS 3,934,055 1/1976 Tamny ..... 239/3
4,275,834 6/1981 Spanjersberg et al. ..... 239/691
4,401,274 8/1983 Coffee ..... 239/690
4,544,570 10/1985 Plunkett et al. ..... 239/691
4,629,119 12/1986 Plunkett et al. ..... 239/690

FOREIGN PATENT DOCUMENTS 249286 12/1987 European Pat. Off. ..... 239/691

*Primary Examiner*—Andres Kashnikow
*Assistant Examiner*—Michael J. Forman
*Attorney, Agent, or Firm*—Frishauf, Holtz, Goodman & Woodward

[57] ABSTRACT

A device for insulating the spray liquid source from the high tension voltage of an electrostatic spray system when using an electrically conductive spray liquid. The device comprises a spray gun (13), a supply line (12) which connects the spray gun (13) to a spray liquid reservoir (10) and which includes a vessel (16) containing a barrier forming liquid (17) of low electrical conductivity and a density other than that of the spray liquid. The vessel (16), which is substantially non-conductive is connected at its inlet end (24) to ground potential and at its outlet end (19) to the same high potential as the spray gun (13). An electrode means (22; 25) is provided in the vessel (16) to expose the spray liquid passing through the vessel (16) to at least one intermediate potential for controlling the tension gradient in the barrier forming liquid by limiting and controlling the charging of the spray liquid.

5 Claims, 2 Drawing Sheets

DEVICE FOR INSULATING THE SPRAY LIQUID SOURCE FROM THE HIGH TENSION VOLTAGE OF AN ELECTROSTATIC SPRAY SYSTEM WHEN USING AN ELECTRICALLY CONDUCTIVE SPRAY LIQUID

BACKGROUND OF THE INVENTION

This invention relates to a device for insulating parts of the spray liquid supply line, the spray liquid reservoir and the feed pump from the high tension voltage of an electrostatic spray systeem when using an electrically conductive liquid spray material such as a water based paint or a paint containing metallic particles.

In particular, the invention concerns a device of the above type in which a vessel containing a barrier forming liquid is incorporated in the spray liquid supply line as described in European patent application No. 87850083.4.

A problem inherent in the above described device is identified as an uncontrolled tension gradient within the barrier forming liquid such that electrical fields of very high magnitudes are formed, and the spray liquid, which is transported through the barrier forming liquid in drop form, is torn up into a cloud of very small droplets. When disintegrated to such an extent, the spray liquid does not respond to gravitation forces, whereby it is difficult to have the spray liquid transported through the barrier forming liquid by the influence of gravitation.

The above problem is solved by the invention as it is defined in the claims.

DETAILED DESCRIPTION

Figure 1:
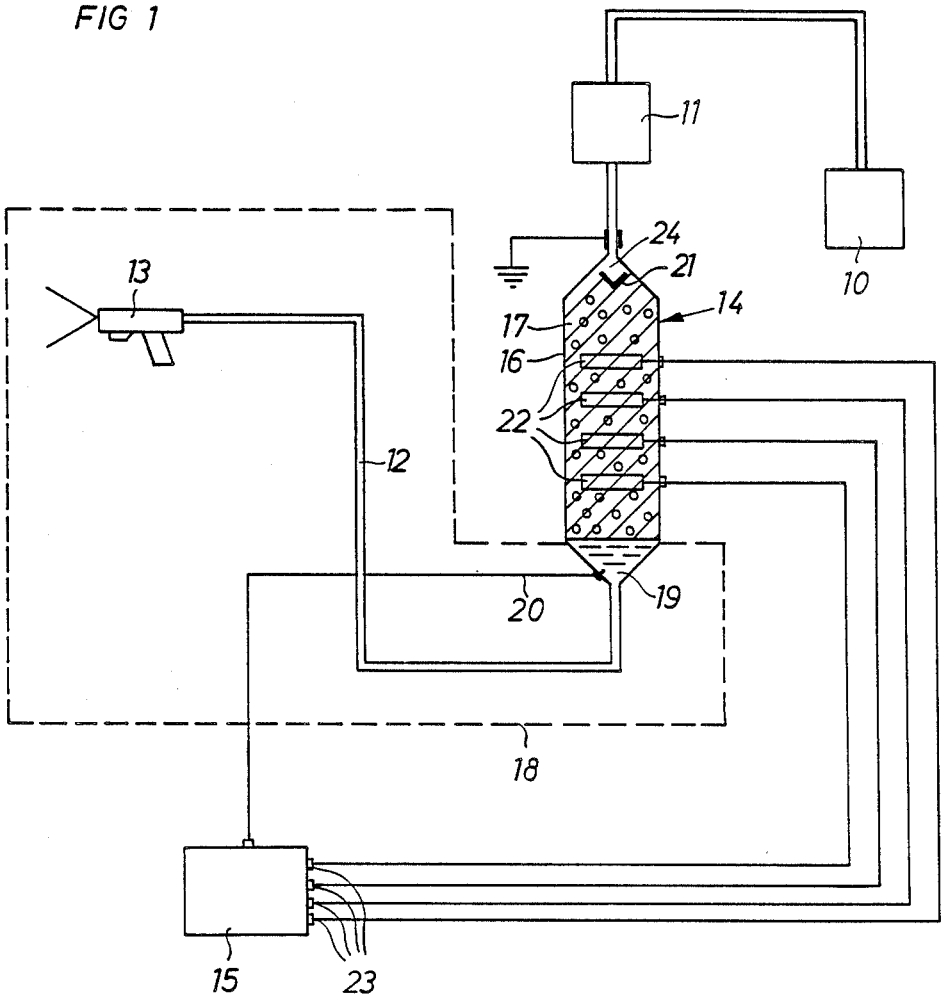
FIG. 1 shows schematically the spray liquid supply means of an electrostatic spray system according to the invention.
Figure 2:
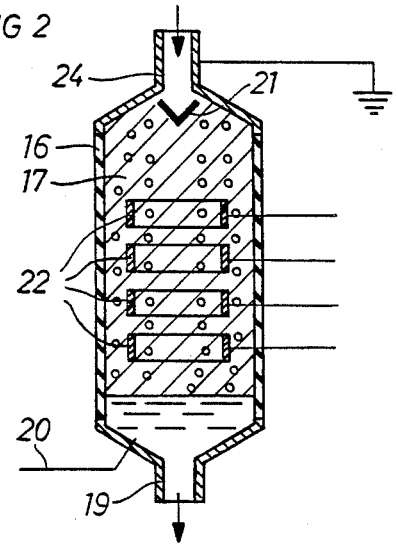
FIG. 2 shows on a larger scale the barrier liquid containing vessel of the spray system shown in FIG. 1.

The spray liquid supply shown in FIG. 1 comprises a spray liquid reservoir 10, a feed pump 11, a supply line 12 connecting the feed pump 11 to an electrostatic spray gun 13, and an insulating device 14 incorporated in the supply line 12. The insulating device 14 comprises a pressure vessel 16 made of a substantially nonconductive material such as plastics, and contains a substantially nonconductive liquid 17 which has the physical properties of not being mixable with the spray liquid and which has a density that is different from that of the spray liquid. In the drawing figures there are shown alternative vessel designs all of which contain a barrier forming liquid which has a lower density than the spray liquid.

As a barrier forming liquid having a density lower than that of a water based paint any suitable fraction of petroleum may be used, for example fuel oil which has a density of about 0.8 g/cm$^3$.

In the spray system shown in FIG. 1, a water based liquid paint is supplied from the reservoir 10 to the electrostatic spray gun 13 via the vessel 16 and the supply line 12. Instead of connecting the high tension source to the spray gun as is common practice in previously known electrostatic spray systems, the high tension source 15 in this improved system is connected via a conduit 20 to the outlet end 19 of the vessel 16. Through the conductive water soluble paint the high tension potential propagates downstream to the spray gun 13. This means that the spray gun 13 as well as the supply line 12 downstream of the vessel 16 are exposed to the high tension voltage and form a high tension section 18 of the system. The electrical lead upstream through the paint is interrupted by the nonconductive barrier forming liquid in the vessel 16.

At the top of the vessel 16 there is located an inlet nozzle 21 by which the paint is disintegrated into small quantities like drops which fall through the insulating liquid 17 by gravity. At the bottom end 19 of the vessel 16, the drops regather to form a continuous paint flow when leaving the vessel 16. Since the paint is transported through the insulating liquid 17 in the form of separate drops, the high tension voltage is not able to propagate further upstream through the paint. Thereby, the paint supply system upstream of the vessel 16, including the feed pump 11 and the paint reservoir 19, is effectively protected from the high tension voltage.

In the embodiment of the invention illustrated in FIG. 1, the barrier liquid containing vessel 16 is provided with four electrode elements 22 located after each other in the flow direction of the spray liquid. These electrode elements 22 are connected to intermediate potential outputs 23 of the high tension source 15. These outputs 23 have different potentials between ground potential and the high potential to which the outlet end 19 of the vessel 16 is charged. The intermediate potentials of the electrode elements 22 are arranged in such a way that a successively increasing potential is obtained toward the outlet end 19 of the vessel 16. The uppermost electrode element may, however, be connected to ground potential. Such an arrangement is advantageous in that the spray liquid would not be exposed to any electrical charging at all during its drop forming sequence when leaving the nozzle 21 at the top of the vessel 16.

By arranging a number of electrode elements with successively increasing potentials, there is obtained a controlled charging of the spray liquid. This is accomplished in that the tension gradient within the vessel 16 is limited to substantially the steps in potential represented by the different electrodes. In a practical application, the high tension potential supplied at the bottom end 19 of the vessel 16 is about 100 kV, and the difference in potential between each of the four electrodes 22 is 20–30 kV.

Figure 3:
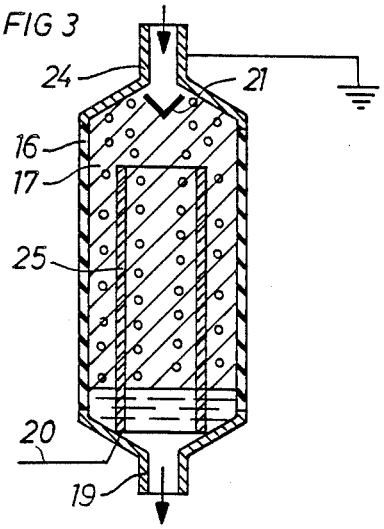
FIGS. 3 and show barrier liquid containing vessels of two alternative embodiments of the invention.

According to the embodiment of the invention shown in FIG. 3, the electrode means for accomplishing a controlled charging of the spray liquid comprises a vertical tube 25 of a low-conductive material. The tube 25 extends upstream in the vessel 16 from the high tension supplied outlet end 19 of the latter. This means that the lower end of the tube 25 is connected to the high potential supplied through the high tension lead 20 and, due to the limited conductivity of the tube 25, a successively decreasing potential is exposed to the liquid over the length of the tube 25. A suitable material to be used in the tube 25 is a conductive plastic, such as carbon impregnated polytetrafluoroethylene.

Figure 4:
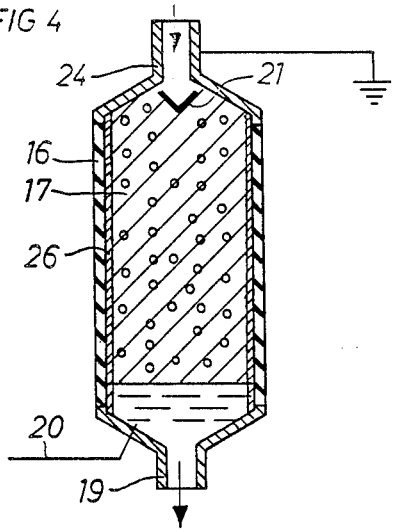

In the embodiment of the invention illustrated in FIG. 4, a successively increased potential is obtained by a lining 26 of a low-conductive material attached to the vessel walls. A suitable material for this lining 26 is the same as mentioned above in connection with the tube shaped electrode.

In a further embodiment of the invention, the walls of the vessel 16 itself are made of a low-conductive material as described above so as to accomplish a successive charging of the spray liquid.

We claim:

1. Device for insulating a spray liquid source from a high tension voltage of an electrostatic spray system when using an electrically conductive spray liquid, comprising:

a spray gun (13) connected to a high potential and to a supply line (12) which connects the spray gun (13) to a spray liquid source (10), and which includes a vessel (16) containing a barrier forming liquid (17) of low electrical cnductivity and a density other than that of the spray liquid;

a spray liquid injection means (21) for disintegrating the spray liquid into drops, and located at an inlet end (24) of said vessel (16);

said vessel (16) being substantially non-conductive between its inlet end (24) which is connected to ground potential and an outlet and thereof (19) which is connected to the same high potential as the spray gun (13); and electrode means.(22; 25) provided between the inlet end (24) of said vessel (16) and the outlet end (19) of said vessel (16), for exposing the spray liquid to at least one intermediate potential for controlling the tension gradient in the barrier forming liquid by limiting and controlling the charging of the spray liquid.

2. Device according to claim 1, wherein said electrode means (22; 25) comprises a number of electrode elements (22) all being spaced from each other as well as from the ends of said vessel (16) in the spray liquid flow direction and being connected to different potentials, such that the electrode element (22) located closest to the inlet end (24) of said vessel (16) has the lowest potential and that the other electrode elements have successively higher potentials toward the outlet end (19) of said vessel (16).

3. Device according to claim 1, wherein said electrode means (22; 25) comprises a surface forming member (25) of a low-conductive material, said surface kforming member (25) extending in the spray liquid flow direction and having its highest potential adjacent the outlet end (19) of said vessel (16).

4. Device according to claim 3, wherein said surface forming member (25) is formed by the inner wall of said vessel (16).

5. Device according to claim 4, wherein said vessel (16) is provided with an inner lining (26) of a low-conductive material.

* * * * *

UNITED STATES PATENT AND TRADEMARK OFFICE

CERTIFICATE OF CORRECTION

PATENT NO. : 4,881,688

DATED : November 21, 1989

INVENTOR(S) : HANKVIST et al

It is certified that error appears in the above-identified patent and that said Letters Patent is hereby corrected as shown below:

Column 4, Claim 3 (line 4), "kforming" should read --forming--.

Signed and Sealed this

Fifteenth Day of January, 1991

*Attest:*

HARRY F. MANBECK, JR.

*Attesting Officer*

*Commissioner of Patents and Trademarks*